US006196453B1

(12) United States Patent
Hutchinson

(10) Patent No.: US 6,196,453 B1
(45) Date of Patent: Mar. 6, 2001

(54) TWO WAY MAILER FOR SIMPLE SEALER

(75) Inventor: Wilbur Hutchinson, St. George, UT (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/484,456

(22) Filed: Jan. 18, 2000

(51) Int. Cl.[7] ..... B65D 27/06
(52) U.S. Cl. ..... 229/305; 229/92.1
(58) Field of Search ..... 229/92.1, 92.3, 229/305

(56) References Cited

U.S. PATENT DOCUMENTS

| | | | | |
|---|---|---|---|---|
| 4,918,128 | * | 4/1990 | Sakai | 524/450 |
| 5,201,464 | | 4/1993 | File . | |
| 5,213,257 | | 5/1993 | Sauerwine . | |
| 5,253,798 | | 10/1993 | Lombardo . | |
| 5,290,225 | * | 3/1994 | Younger | 229/92.1 X |
| 5,360,160 | * | 11/1994 | Sauerwine et al. | 229/305 X |
| 5,366,145 | | 11/1994 | Sauerwine . | |
| 5,376,048 | * | 12/1994 | Whiteside | 229/92.1 X |
| 5,425,500 | * | 6/1995 | Sauewine | 229/92.3 X |
| 5,452,851 | | 9/1995 | Albert et al. . | |
| 5,513,795 | | 5/1996 | Sauerwine . | |
| 5,553,774 | * | 9/1996 | Goodno | 229/305 X |
| 5,642,855 | * | 7/1997 | Michlin | 229/305 |
| 5,785,242 | | 7/1998 | Lombardo . | |
| 5,829,670 | | 11/1998 | Lombardo et al. . | |
| 5,893,512 | | 4/1999 | Diedrich . | |
| 5,950,909 | | 9/1999 | Peterson et al. . | |

OTHER PUBLICATIONS

Brochure for "PS–2 Speedisealer® Pressure Seal System", 1995.

* cited by examiner

*Primary Examiner*—Jes F. Pascua
(74) *Attorney, Agent, or Firm*—Nixon & Vanderhye PC

(57) ABSTRACT

A mailer type business form intermediate is specifically constructed for use with a popular simple pressure sealer so that a mailer type business form with a built in reply envelope may be easily produced from the intermediate simply by feeding it through the conventional sealer. The intermediate is constructed with the first and second lines of weakness located more inwardly than conventional, so that the patterns of pressure sensitive cohesive forming the reply envelope are, and those sealing the mailer, each have an effective width of about ⅜ of an inch or less and are spaced from each other in a first dimension parallel to the top and bottom edges of the intermediate a distance greater than about a quarter of an inch and less than about one inch, preferably so that the center lines of the cohesive pattern are spaced from each other substantially the same distance that center lines of parallel sealing rollers of a conventional sealer are spaced from each other.

20 Claims, 5 Drawing Sheets

TWO WAY MAILER FOR SIMPLE SEALER

BACKGROUND AND SUMMARY OF THE INVENTION

In the production of pressure seal mailer type business forms, such as disclosed in U.S. Pat. Nos. 5,785,242, 5,553,774, 5,513,795, 5,253,798, 5,201,464, and 5,366,145, various types of pressure seal equipment such as manufactured and sold by Moore North America, Inc. of Bannockburn, Ill. are provided. Typically, however, two way mailer constructions are not possible to produce using one of the simplest and most effective pieces of pressure seal equipment known as the Moore PS-2 (Model 4420) pressure sealer. When utilizing that pressure sealer typically nested envelopes are utilized, however that limits the speed of the mailer production to about 4500 mailers per hour. By effectively using the PS-2 sealer with a mailer having a built in reply envelope, it would be possible to increase the production speed to about 10,000 units per hour.

According to the present invention an intermediate for a mailer type business form, and a method of making a mailer type business form from the intermediate, and the mailer type business form so produced, are provided which allow production utilizing the Moore PS-2 sealer, so that the high rate of production set forth above, and other advantages, may be achieved. This is accomplished by changing the location of the pressure activated cohesive (such as disclosed in U.S. Pat. Nos. 4,918,128 and 5,201,464) for forming the reply envelope so that the patterns of cohesive are more inward of the side edges of the intermediate and mailer than otherwise are conventional. The cohesive patterns for sealing the reply envelope are positioned so that they are aligned with the spaced rollers of the PS-2 sealer when other rollers of that sealer are aligned with the pressure sensitive cohesive in the side margins of the intermediate/mailer which seal the form for mailing. The invention is particularly suitable for use in eccentric C-folded configurations of intermediates/mailers.

According to one aspect of the present invention a mailer type business form intermediate is provided comprising: A substantially quadrate cut sheet of paper having first and second faces, top and bottom edges substantially parallel to each other, and first and second side edges substantially perpendicular to the top and bottom edges and substantially parallel to each other. The top and bottom edges spaced a first distance, and the side edges spaced a second distance, less than the first distance. First and second lines of weakness formed in the sheet adjacent, but spaced from and substantially parallel to, the first and second side edges, respectively, to define first and second removable side margin portions. First and second fold lines formed in the sheet substantially parallel to the top and bottom edges, and defining the sheet into first, second and third panels. At least one first pattern of pressure activated cohesive in each of the side margins on at least one of the faces, the patterns for holding the sheet in a folded configuration as a mailer. The first panel is defined between the top edge and the second fold line, the second panel between the first and second fold lines, and the third panel between the second fold line and the bottom edge. Second patterns of pressure activated cohesive on the first face in the second and third panels cooperating with each other when the intermediate is C-folded about the second fold line to define a reply envelope, and disposed on the opposite sides of the first and second lines of weakness from the first and second side edges. A reply envelope closing flap formed in one of the panels and extending substantially parallel to the top and bottom edges. A pattern of adhesive provided in the closing flap. And, the second and first patterns of pressure sensitive cohesive each having an effective width of about ⅜ inch or less, and spaced from each other in a first dimension parallel to the top and bottom edges a distance of greater than about 0.25 inches and less than about one inch.

By providing the first and second patterns of pressure sensitive cohesive so that they have effective width, and spacing, set forth above, they will be aligned with the rollers of a Moore PS-2 pressure sealer. Preferably the first and second patterns each have centerlines; and the centerlines are spaced from each other substantially the same distance that centerlines of parallel sealing rollers of a Moore PS-2 pressure sealer are spaced from each other. For example the centerlines are spaced from each other a distance between about three-quarters and seven-eighths of an inch.

The first and second patterns may be strips of cohesive; for example the first patterns may be discontinuous strips of cohesive translated in the first dimension (that is some portions spaced from others in the first dimension), and the second patterns are substantially continuous strips of cohesive. Typically the first patterns of cohesive are also provided on the second face of the third panel. Also third patterns of pressure activated cohesive may be provided on the second face of the third panel adjacent the second fold line and elongated in the first dimension, and the third patterns may have length in the first dimension of at least about one-half inch, so that they are also activated by the rollers of the PS-2 sealer.

In one preferred embodiment the flap is disposed in the second panel spaced at least one-half inch (e.g. more than an inch) from the first fold line, and the first and second lines of weakness are spaced about 0.7–0.8 inches (e.g. about three-quarters of an inch) from the first and second side edges, respectively. Preferably the sheet side edges have a length of about eleven-twelve inches (typically either eleven or twelve inches, the twelve inch length being disclosed in pending U.S. patent application Ser. No. 09/461,374 filed Dec. 15, 1999, and the top and bottom edges typically have a length of between about eight-nine inches, preferably about eight and a half inches.

The invention also relates to a method of making a mailer type business form from an intermediate as described above utilizing a pressure sealer having a plurality of rollers spaced from each other in the first dimension and each having a width substantially as great as or greater than the effective width of each of the first and second patterns of cohesive—preferably the Moore PS-2 sealer. The method comprises the steps of: (a) C-folding the sheet about the first and second fold lines to bring cooperating portions of both the first and second patterns of cohesive into engagement with each other; and (b) passing the folded intermediate through the pressure sealer so that rollers operatively engage the intermediate aligned with each of the first and second patterns of cohesive to form a completed sealed mailer type business form with a self-contained reply envelope.

Typically (a) is practiced by eccentrically C-folding the sheet. For example the third panel is of smaller length dimension than the first and second panels, and the flap is in the second panel spaced from the first fold line, in which case (a) is further practiced so that the third panel does not cover the flap. As described above preferably (b) is practiced using a Moore PS-2 pressure sealer.

By practicing the method as described above it is possible to effectively produce about 10,000 mailers per hour, as compared to about 4,500 mailers per hour if a nested return envelope is required. For example (b) is practiced at a production rate of greater than 7,000 mailers per hour, e.g. about 10,000 per hour, and all ranges between about 7,000–10,000.

The invention also relates to the mailer type business form produced by the method as described above and from the intermediate as described above.

It is the primary object of the present invention to provide an intermediate for a mailer type business form, a method of making the mailer, and the mailer so produced, which are advantageous in that a particularly desirable sealer (such as the Moore PS-2 sealer) can be utilized to effectively produce a mailer type business form with a built in reply envelope. This and other objects of the invention will become clear from an inspection of the detailed description of the invention and from the appended claims.

DETAILED DESCRIPTION OF THE DRAWINGS

Figure 1:
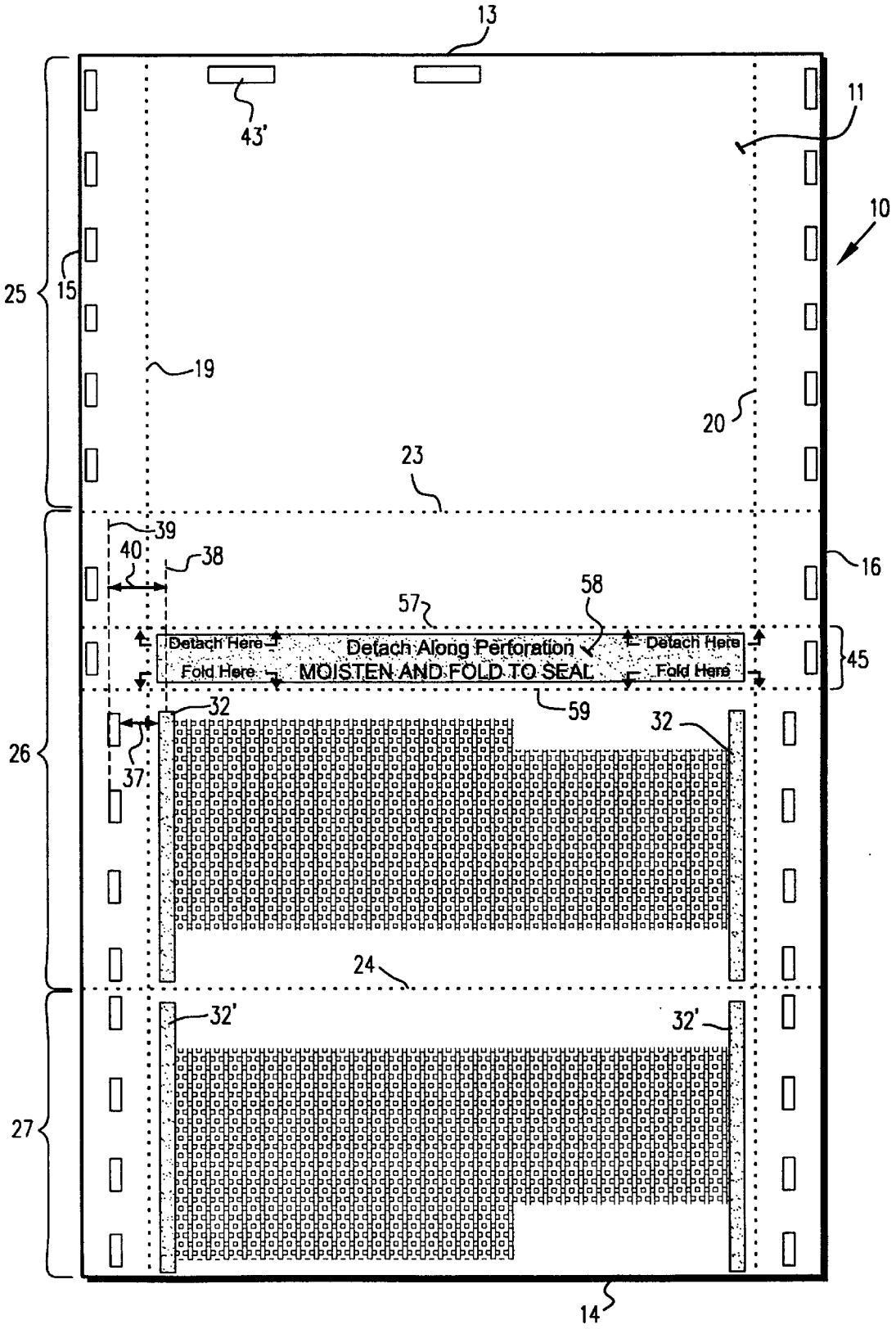
FIGS. 1 and 2 are top plan views of opposite faces of an exemplary intermediate for a mailer type business form according to the present invention.

FIG. 1 illustrates a mailer type business form intermediate shown generally by reference numeral 10 which comprises a substantially quadrate cut sheet of paper. The sheet of paper forming the intermediate 10 has a first face 11 seen in FIG. 1, and a second 12 (see FIG. 2) opposite the first face. The sheet of paper forming the intermediate 10 also has top and bottom edges 13,14, respectively, substantially parallel to each other, and first and second side edges 15,16, respectively, substantially parallel to each other and substantially perpendicular to the top and bottom edges 13,14. The top and bottom edges 13,14 are spaced a first distance 17 while the side edges 15,16 are spaced a second distance 18, the distance 18 being less than the distance 17. The distance 17 is preferably between about eleven–twelve inches. While the distance 18 (the width of the sheet of paper forming the intermediate 10) may vary, preferably it is substantially equal to 8½ inches, e.g. between about eight–nine inches.

The intermediate 10 also comprises first and second lines of weakness 19, 20, respectively, such as perforation lines, formed in the sheet of paper adjacent, but spaced from, and substantially parallel to, the side edges 15,16, respectively, to define first and second removable side margin portions 21, 22. First and second fold lines 23, 24 are formed in the sheet substantially parallel to the top and bottom edges 13,14, defining the sheet into three (first, second and third) panels 25, 26, and 27.

Figure 5:
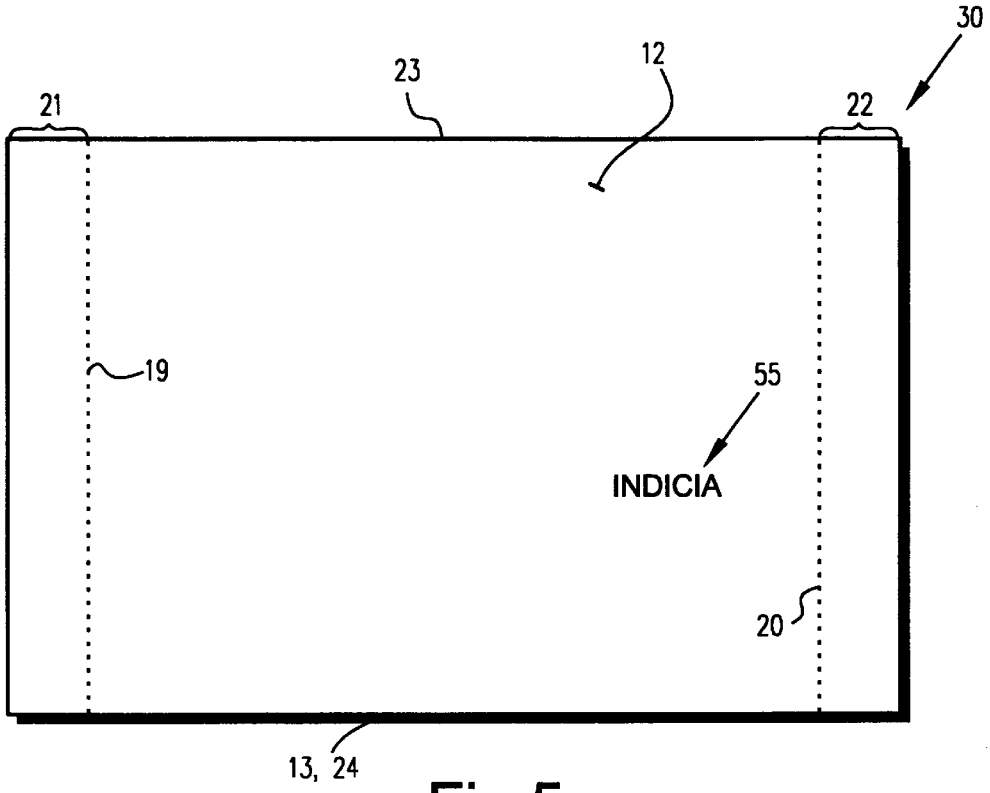
FIG. 5 is a top plan view of the mailer formed by eccentric C-folding as illustrated in FIG. 3, and using the sealer of FIG. 4.

The intermediate 10 also comprises patterns of pressure activated cohesive (such as described in U.S. Pat. Nos. 5,201,464 and 4,918,128, incorporated by reference herein) in the side margin portions 21, 22 on at least one of the faces 11, 12. These patterns are for holding the sheet forming the intermediate 10 in a folded configuration as the final mailer, the sheet 10 being C-folded (preferably eccentrically C-folded) to form a mailer as illustrated schematically in FIG. 3, and to form the final mailer 30 schematically illustrated in FIG. 5. The cohesive patterns may comprise any configuration such as lines, spots, dots, bars, strips, discontinuous or continuous, or any other suitable configuration. The patterns of cohesive are placed in the side margins 21, 22, and perhaps elsewhere, depending upon the exact construction of the final mailer.

Figure 2:
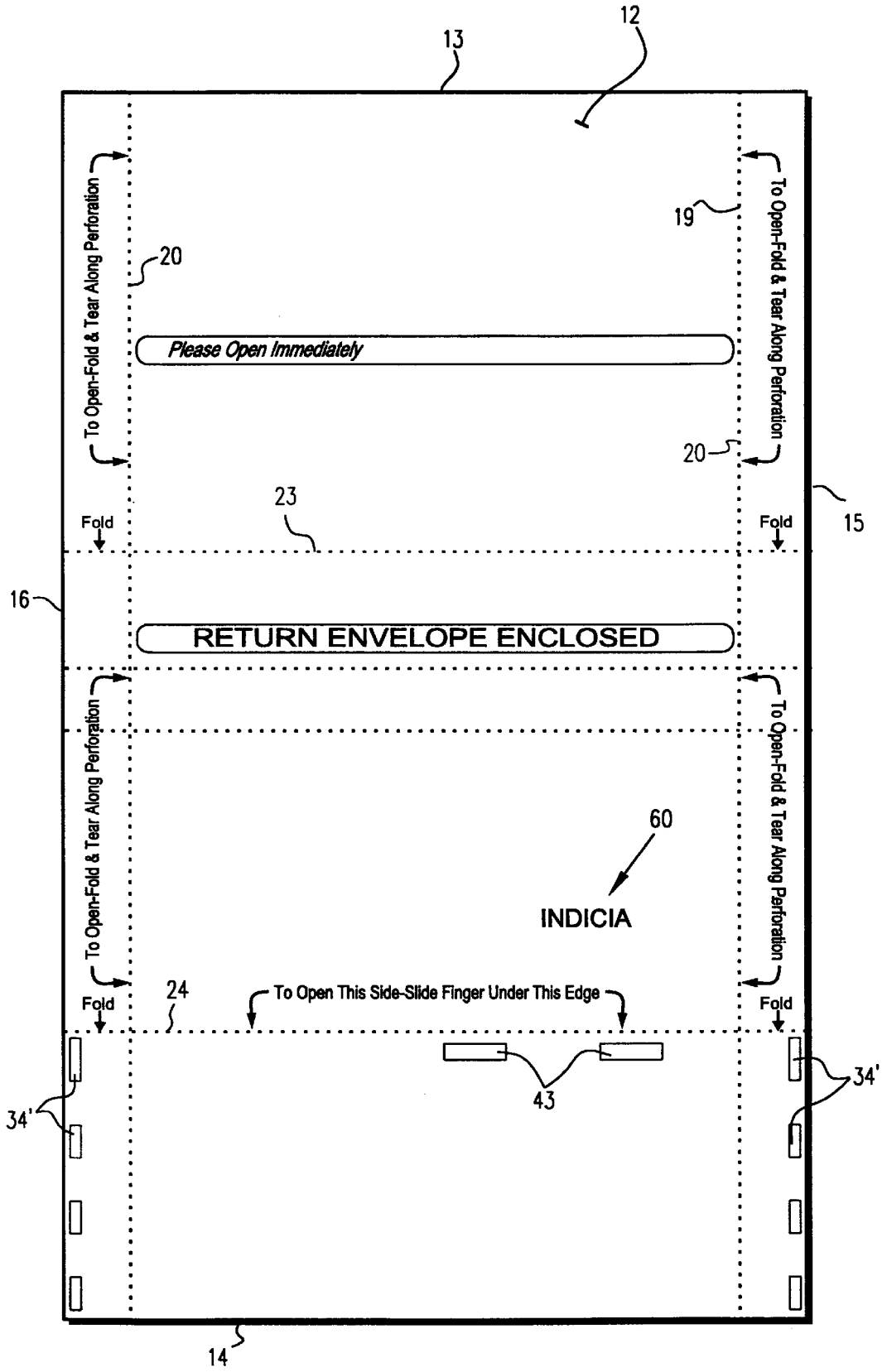
Figure 3:
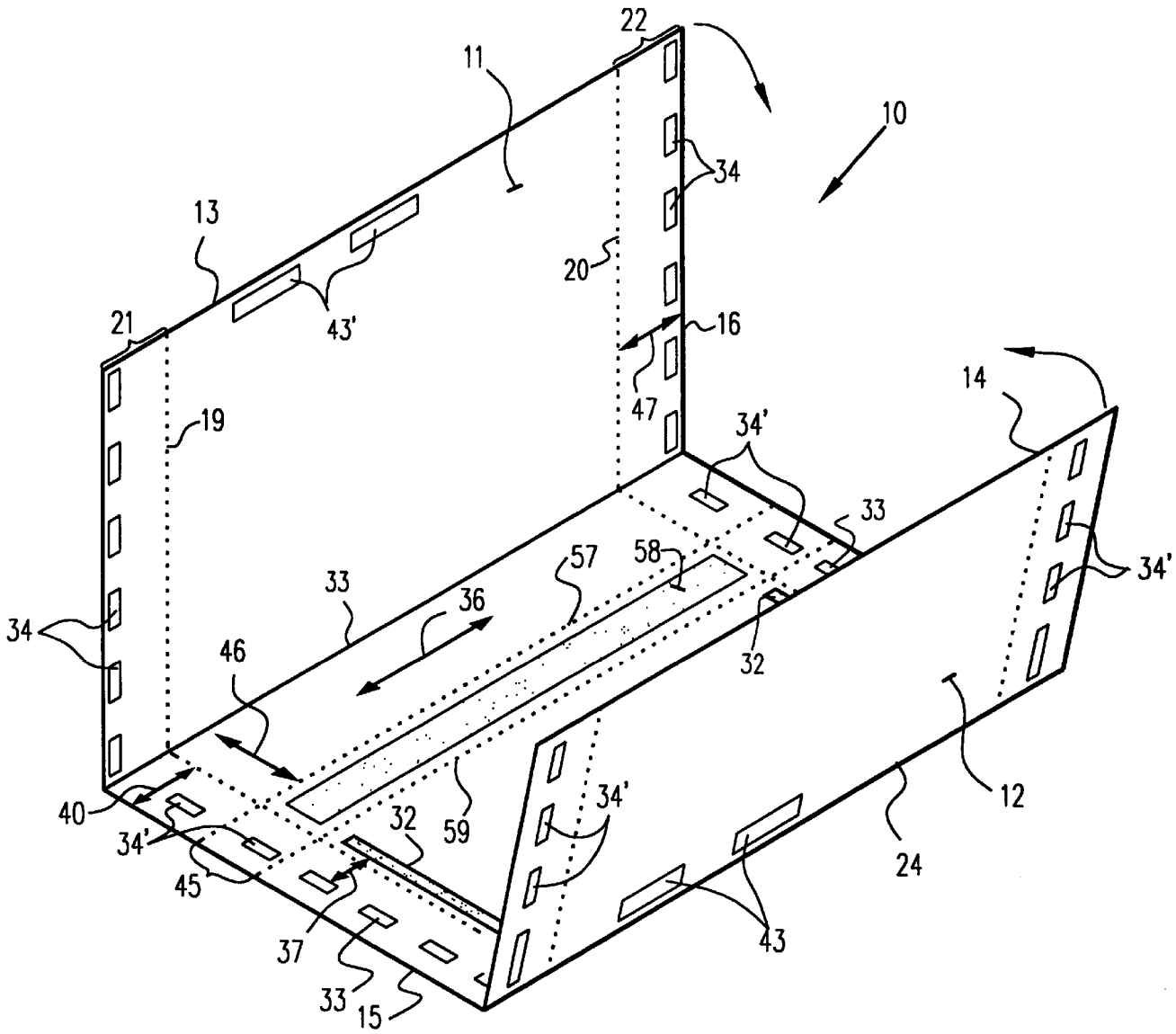
FIG. 3 is a schematic perspective view showing the intermediate of FIGS. 1 and 2 being eccentrically C-folded to produce a final mailer.

The major differences between the intermediate 10 of FIGS. 1 through 3 and a conventional C-fold pressure seal mailer intermediate having a reply envelope, are the positioning of the second patterns of pressure sensitive cohesive for holding the reply envelope together, and typically the positioning of the first and second lines of weakness 19, 20, to facilitate utilization of the intermediate 10 with a Moore PS-2 sealer.

The second patterns of pressure activated cohesive are seen by reference numeral 32 in FIGS. 1 and 3 and also by 32' in FIG. 1. The patterns 32, 32' are adjacent the lines of weakness 19, 20 and on the opposite sides thereof from the side edges 15, 16, respectively, and the pattern portions 32, 32' on opposite sides of the second fold line 24 cooperate with each other when the intermediate 10 is eccentrically C-folded about the fold line 24.

The first patterns of pressure activated cohesive are shown by reference numerals 33, 33' in FIGS. 1 and 3, and 34, 34' in FIGS. 1, 2, and 3. The pattern portions 33, 33' are translated in a first dimension 36 from the pattern portions 34, 34', as illustrated in FIGS. 1 through 3, but it is to be understood that if desired and if no portion of the patterns 34' are to be provided on the face 12, then no translated portions need be provided but all of the patterned components 33, 33', 34, 34', may be in a straight line. While the patterns 32, 32' are shown as substantially continuous it is to be understood that they also could be discontinuous and have other configurations as described above.

The effective width of all of the patterns 32, 32' and 33, 34, 33', 34', is about three-eighths inch or less and they are spaced from each other in the first dimension 36 parallel to the top and bottom edges 13, 14 a distance 37 of greater than about a quarter of an inch and less than about one inch, typically about three-eighths to one half inch. The centerlines, shown schematically at 38 for the patterns 32, 32', and 39 for the patterns 33, 33', 34, 34', are spaced from each other between about three quarters and seven eighths of an inch, or any other distance that is appropriate so that they are substantially the same distance that centerlines of parallel sealing rollers of a Moore PS-2 pressure sealer are spaced from each other. Such rollers are illustrated schematically at 41 in FIG. 4 in association with a schematically illustrated Moore PS-2 pressure sealer 42.

Other pressure sensitive cohesive patterns may also be provided associated with the intermediate 10, such as the third patterns of pressure activated cohesive 43, 43' provided on the second face of the third panel 27 adjacent the second fold line 24 and elongated in the first dimension 36, the third patterns 43 having a length in the first dimension of at least about one half inch, and cooperating with corresponding third patterns 43' on the first face 11 of the first panel 25 adjacent the top edge 13.

The intermediate 10 also has a reply envelope closing flap, shown schematically at 45 in FIGS. 1 and 3, in one of the panels and extending substantially parallel to the top and bottom edges 13, 14. In the preferred embodiment illustrated in the drawings the flap 45 is disposed in the second panel 26 spaced a distance 46 from the first fold line 23 that is greater than a half an inch, typically greater than an inch; and the third panel 27, as illustrated in the drawings, typically has a length significantly less than the substantially identical lengths 25, 26 (along the edges 15, 16) of the first and second panels 25, 26, so that the mailer has an eccentric C-fold configuration, as is clear from FIG. 3. Also the lines of weakness 19, 20 are spaced from the side edges 15, 16, respectively, greater than in a conventional C-fold pressure seal mailer. The spacings 47 are preferably between about 0.7–0.8 inches, e.g. about 0.75 inches.

Figure 4:
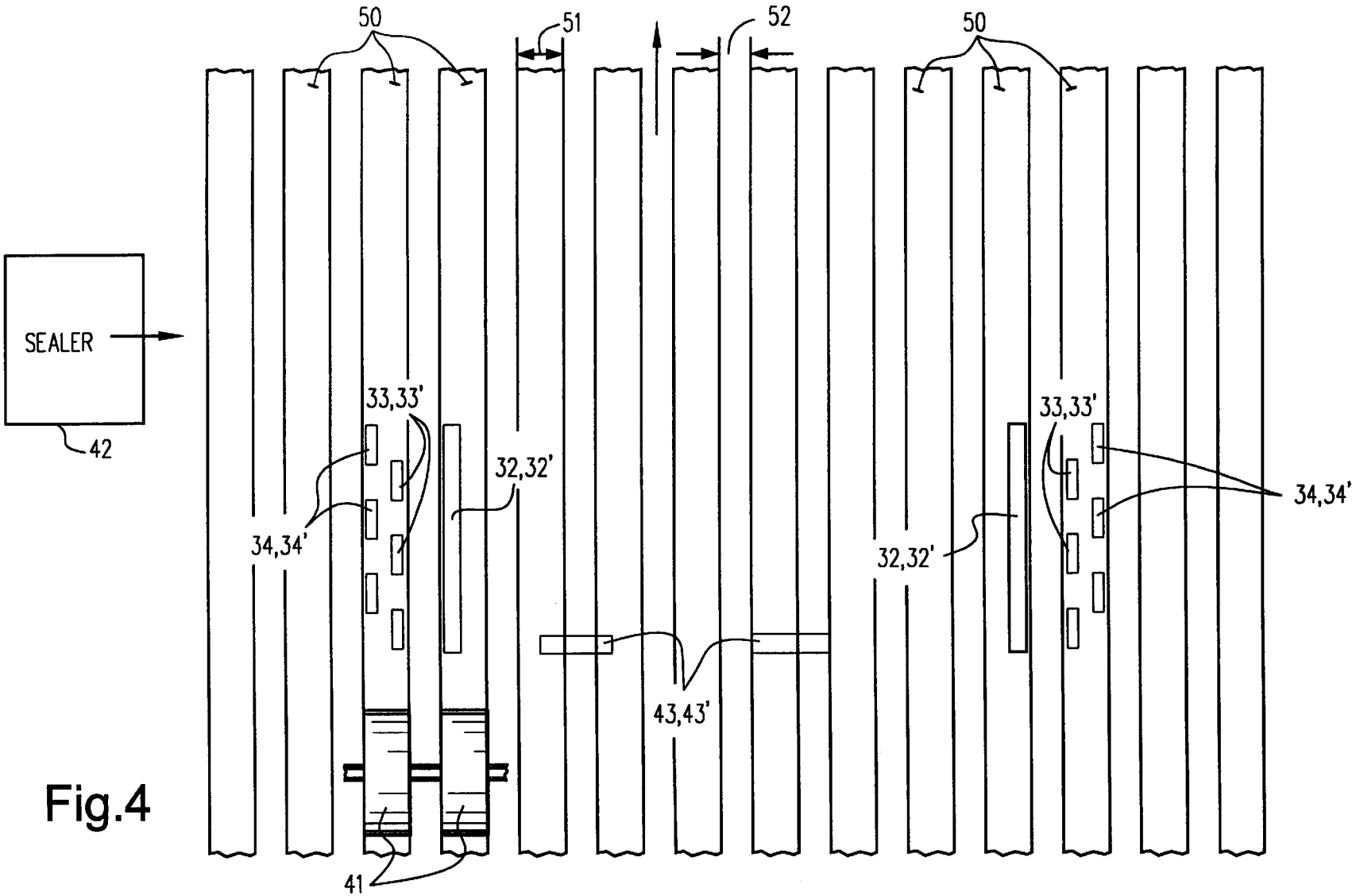
FIG. 4 is a schematic view illustrating the cooperation between the rollers of a Moore PS-2 sealer and the patterns of pressure sensitive cohesive according to the intermediate and mailer of the invention.

FIG. 4 schematically illustrates how the particular dimensioning and spacing of the pressure sensitive cohesive patterns 32, 32', 33, 33', 34, 34', and 43, 43', cooperate with rollers 41 of a Moore PS-2 pressure sealer 42. The "tracks" of each of the plurality of rollers 41 of the pressure sealer 42 are schematically illustrated by the bars 50 as seen in FIG. 4. The width 51 of each of the rollers 41/bars 50, is preferably between about three eighths-one half inch, e.g. about seven sixteenths of an inch, and the spacing 52 between the rollers 41/bars 50 is between about one quarter and three eighths inch, e.g. about five sixteenths of an inch.

As schematically illustrated in FIG. 4, when the intermediate 10 is eccentrically C-folded as indicated schematically in FIG. 3, about first the fold line 24 and then the fold line 23, the intermediate 10 is then fed into the sealer 42 with margin edges so as to guide the edges 15, 16 so that they are positioned directly in alignment with a roller 41, as illustrated in FIG. 4. Because of the spacings 37 and 40 (between the centerlines 38, 39) the cohesive patterns 32, 32' are also engaged by a roller 41 at the same time that the patterns 33, 33' and 34, 34' are engaged. Also at least significant portions of the patterns 43, 43' are engaged. Thus the sealer 42, by applying a sealing force of at least about a hundred pounds per lineal inch, produces a properly sealed mailer 30 (which may have address indicia, schematically illustrated at 55 in FIG. 5, imaged on the second face 12 of first panel 25 thereof) that is ready for mailing.

Figure 6:
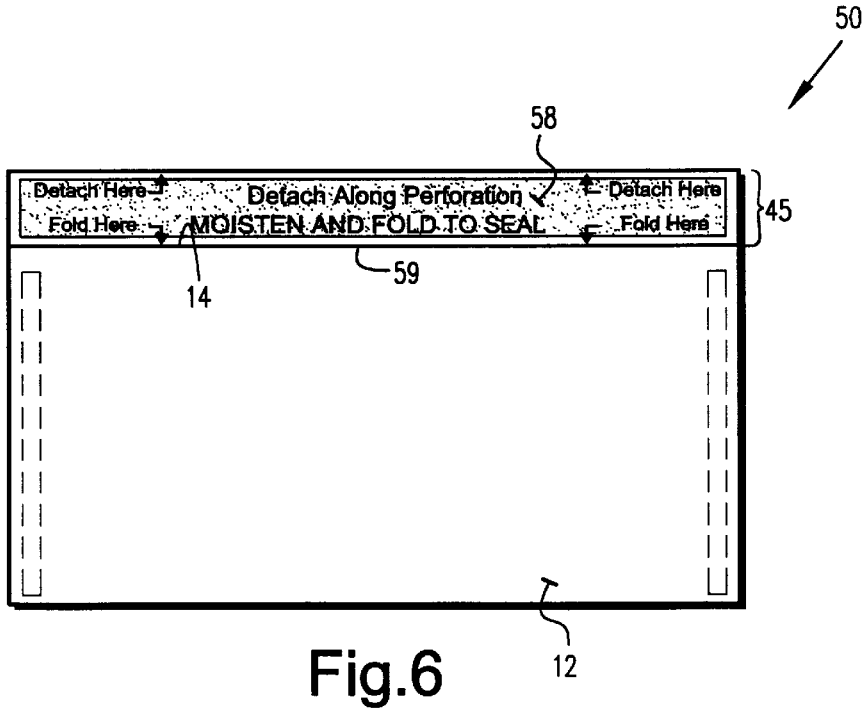
FIG. 6 is a plan view of the reply envelope separated from the mailer of FIG. 5 after that mailer is opened.

Upon receipt by the addressee of the mailer 30, the strips 21, 22 are separated about the perforation lines 19, 20, and also the return envelope 56 seen in FIG. 6 is separated from the rest of the second panel 26 about the perforation line 57. In this condition the adhesive (which may be rewettable adhesive, or the like) 58 is brought into contact with the face 12 of the third panel 27 by pivoting of the flap 45 about the fold line 59 to seal the reply envelope 56 which may have the reply indicia 60 (see FIG. 2) imaged thereon.

Thus the mailer type business form 30 is constructed by C-folding (preferably eccentrically C-folding) the intermediate 10 about the fold line 24 and then the fold line 23, as illustrated in FIG. 3, to bring cooperating portions of the patterns of cohesive 32, 32', 33, 33', 34, 34', and also preferably the third portions 43, 43'; into engagement with each other; and then passing the intermediate 10 so folded through the pressure sealer 42 so that rollers 41 operatively engage all the patterns of cohesive to form a completed sealed mailer 30 with self-contained reply envelope 56.

While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent products and method.

What is claimed is:

1. A mailer type business form intermediate comprising:

a substantially quadrate cut sheet of paper having first and second faces, top and bottom edges substantially parallel to each other, and first and second side edges substantially perpendicular to said top and bottom edges and substantially parallel to each other;

said top and bottom edges spaced a first distance, and said side edges spaced a second distance, less than said first distance;

first and second lines of weakness formed in said sheet adjacent, but spaced from and substantially parallel to, said first and second side edges, respectively, to define first and second removable side margin portions;

first and second fold lines formed in said sheet substantially parallel to said top and bottom edges, and defining said sheet into first, second and third panels;

at least one first pattern of pressure activated cohesive in each of said side margins on at least one of said faces, said patterns for holding said sheet in a folded configuration as a mailer;

said first panel defined between said top edge and said first fold line, said second panel between said first and second fold lines, and said third panel between said second fold line and said bottom edge;

second patterns of pressure activated cohesive on said first face in said second and third panels cooperating with each other when the intermediate is C-folded about said second fold line to define a reply envelope, and disposed on the opposite sides of said first and second lines of weakness from said first and second side edges;

a reply envelope closing flap formed in one of said panels and extending substantially parallel to said top and bottom edges;

a pattern of adhesive provided in said closing flap; and said second and first patterns of pressure sensitive cohesive each having an effective width of about ⅜ inch or less, and spaced from each other in a first dimension parallel to said top and bottom edges a distance of greater than about 0.25 inches and less than about one inch.

2. An intermediate as recited in claim 1 wherein said first and second patterns are strips of cohesive.

3. An intermediate as recited in claim 2 wherein said first patterns are discontinuous strips of cohesive translated in said first dimension, and wherein said second patterns are substantially continuous strips of cohesive.

4. An intermediate as recited in claim 1 wherein said first and second patterns each have centerlines; and wherein said centerlines are spaced from each other substantially the same distance that centerlines of parallel sealing rollers of a Moore PS-2 pressure sealer are spaced from each other.

5. An intermediate as recited in claim 1 wherein said first and second patterns each have centerlines, and wherein said centerlines are spaced from each other between about ¾ and ⅞ of an inch.

6. An intermediate as recited in claim 5 wherein said sheet side edges have a length of between about eleven–twelve inches, and wherein said top and bottom edges have a length of between about 8–9 inches.

7. An intermediate as recited in claim 1 wherein said first patterns of cohesive are also provided on said second face of said third panel.

8. An intermediate as recited in claim 1 further comprising third patterns of pressure activated cohesive provided on said second face of said third panel adjacent said second fold line and elongated in said first dimension, said third patterns having a length in said first dimension of at least about ½ inch.

9. An intermediate as recited in claim 1 wherein said flap is disposed in said second panel spaced at least ½ inch from said first fold line.

10. An intermediate as recited in claim 1 wherein said first and second lines of weakness are spaced about 0.7–0.8 inches from said first and second side edges, respectively.

11. An intermediate as recited in claim 6 wherein said sheet side edges have a length of between about eleven–twelve inches, and wherein said top and bottom edges have a length of between about 8–9 inches.

12. A method of making a mailer type business form from an intermediate using a pressure sealer having a plurality of rollers spaced from each other in the first dimension and each having a width substantially as great as or greater than the effective width of each of said first and second patterns of cohesive, the intermediate comprising a substantially quadrate cut sheet of paper having first and second faces, top and bottom edges substantially parallel to each other, and first and second side edges substantially perpendicular to said top and bottom edges and substantially parallel to each other; said top and bottom edges spaced a first distance, and said side edges spaced a second distance, less than said first distance; first and second lines of weakness formed in said sheet adjacent, but spaced from and substantially parallel to, said first and second side edges, respectively, to define first and second removable side margin portions; first and second fold lines formed in said sheet substantially parallel to said top and bottom edges, and defining said sheet into first, second and third panels; at least one first pattern of pressure activated cohesive in each of said side margins on at least one of said faces, said patterns for holding said sheet in a folded configuration as a mailer; said first panel defined between said top edge and said first fold line, said second panel between said first and second fold lines, and said third panel between said second fold line and said bottom edge; second patterns of pressure activated cohesive on said first face in said second and third panels cooperating with each other when the intermediate is C-folded about said second fold line to define a reply envelope, and disposed on the opposite sides of said first and second lines of weakness from said first and second side edges; a reply envelope closing flap formed in one of said panels and extending substantially parallel to said top and bottom edges; a pattern of adhesive provided in said closing flap; and said second and first patterns of pressure sensitive cohesive each having an effective width of about ⅜ inch or less, and spaced from each other in a first dimension parallel to said top and bottom edges a distance of greater than about 0.25 inches and less than about one inch; and said method comprising:

(a) C-folding the sheet about the first and second fold lines to bring cooperating portions of both said first and second patterns of cohesive into engagement with each other; and (b) passing the folded intermediate through the pressure sealer so that rollers operatively engage the intermediate aligned with each of the first and second patterns of cohesive to form a completed sealed mailer type business form with a self-contained reply envelope.

13. A method as recited in claim 12 wherein (a) is practiced by eccentrically C-folding the sheet.

14. A method as recited in claim 13 wherein the third panel is of smaller length dimension than the first and second panels, and the flap is in the second panel spaced from the first fold line; and wherein (a) is further practiced so that the third panel does not cover the flap.

15. A mailer type business form made by practicing the method of claim 14.

16. A method as recited in claim 12 wherein (b) is practiced using a Moore PS-2 pressure sealer.

17. A mailer type business form made by practicing the method of claim 16.

18. A mailer type business form made by practicing the method of claim 12.

19. A method of making a mailer type business form from an intermediate using a pressure sealer having a plurality of rollers spaced from each other in the first dimension and each having a width substantially as great as or greater than the effective width of each of said first and second patterns of cohesive, the intermediate comprising a substantial quadrate cut sheet of paper having first and second faces, top and bottom edges substantially parallel to each other, and first and second side edges substantially perpendicular to said top and bottom edges and substantially parallel to each other; said top and bottom edges spaced a first distance, and said side edges spaced a second distance, less than said first distance; first and second lines of weakness formed in said sheet adjacent, but spaced from and substantially parallel to, said first and second side edges, respectively, to define first and second removable side margin portions; first and second fold lines formed in said sheet substantially parallel to said top and bottom edges, and defining said sheet into first, second and third panels; at least one first pattern of pressure activated cohesive in each of said side margins on at least one of said faces, said patterns for holding said sheet in a folded configuration as a mailer; said first panel defined between said top edge and said first fold line, said second panel between said first and second fold lines, and said third panel between said second fold line and said bottom edge; second patterns of pressure activated cohesive on said first face in said second and third panels cooperating with each other when the intermediate is C-folded about said second fold line to define a reply envelope, and disposed on the opposite sides of said first and second lines of weakness from said first and second side edges; a reply envelope closing flap formed in one of said panels and extending substantially parallel to said top and bottom edges; a pattern of adhesive provided in said closing flap; and said second and first patterns of pressure sensitive cohesive each having an effective width of about ⅜ inch or less, and spaced from each other in a first dimension parallel to said top and bottom edges a distance of greater than about 0.25 inches and less than about one inch; and wherein said flap is disposed in said second panel spaced at least ½ inch from said first fold line; and said method comprising:

(a) C-folding the sheet about the first and second fold lines to bring cooperating portions of both said first and second patterns of cohesive into engagement with each other; and (b) passing the folded intermediate through the pressure sealer so that rollers operatively engage the intermediate aligned with each of the first and second patterns of cohesive to form a completed mailer type sealed business form with a self-contained reply envelope; and wherein (b) is practiced at a production rate of greater than 7,000 mailers per hour.

20. A mailer type business form made by practicing the method of claim 19.

* * * * *